US005794863A

United States Patent [19]

Kochnev et al.

[11] Patent Number: 5,794,863

[45] Date of Patent: Aug. 18, 1998

[54] DEVICE FOR DISINTEGRATION OF ARGILLACEOUS MATERIALS

[76] Inventors: Vladimir Georgievich Kochnev, UL. Kustodieva, D.20, kv.171, 194352 Saint Petersburg; Sergey Albertovich Simankin, UL. d.uStinova, D.6, kv .208, 193177 Saint Petersburg, both of Russian Federation

[21] Appl. No.: 765,299

[22] PCT Filed: Jun. 22, 1994

[86] PCT No.: PCT/RU94/00133

§ 371 Date: Feb. 24, 1997

§ 102(e) Date: Feb. 24, 1997

[87] PCT Pub. No.: WO95/35166

PCT Pub. Date: Dec. 28, 1995

[51] Int. Cl.[6] ..... B03B 5/32

[52] U.S. Cl. ..... 241/40; 241/46.02

[58] Field of Search ..... 241/40, 46.02, 241/1, 5

[56] References Cited

U.S. PATENT DOCUMENTS

| | | | |
|---|---|---|---|
| 1,403,399 | 1/1922 | Frist | 241/40 X |
| 2,949,245 | 8/1960 | Faulk | 241/40 X |
| 4,059,231 | 11/1977 | Neu | 241/5 |
| 4,280,664 | 7/1981 | Jackson et al. | 241/39 |
| 5,499,770 | 3/1996 | McCullough | 241/1 |

FOREIGN PATENT DOCUMENTS

| | | |
|---|---|---|
| 724190 | 3/1980 | U.S.S.R. . |
| 856560 | 2/1982 | U.S.S.R. . |
| 1217475 | 3/1986 | U.S.S.R. . |
| 1303190 | 4/1987 | U.S.S.R. . |

*Primary Examiner*—John M. Husar

*Attorney, Agent, or Firm*—Merchant, Gould, Smith, Edell, Welter & Schmidt

[57] ABSTRACT

A device for disintegration of argillaceous materials comprises a plurality of vanes 8 mounted on the inner surface of the housing 1 between the outlets of the feed pipes 2 and 3 and the inlets of the discharge pipes 4 and 5. Each of the vanes 8 is arranged in a manner such that the angle between the tangent 11 to the cylindrical surface 1 in the plane of the vane 8 and the plane 12 perpendicular to the axis 6 of the housing 1, is between 0 and 60 degrees. As the hydraulic fluid stream impinges upon the vanes 8, the argillaceous material is multiply exposed to pressure differentials and cavitation, this favoring faster impregnation of clay lumps with water and their disintegration leading to separation of mineral grams.

2 Claims, 2 Drawing Sheets

DEVICE FOR DISINTEGRATION OF ARGILLACEOUS MATERIALS

FIELD OF THE INVENTION

The present invention is in the field of mineral dressing and may be used for separating so lid mineral particles from a mass cemented by an argillaceous substance.

PRIOR ART

There is known a device for washing minerals to remove clay impurities (SU, Al, 1,303,190), comprising a washing tank, with two electrodes installed therein and connected to a half-wave a.c. rectifier, and a comb-type agitator complete with a drive. The material fed into the washing tank is poured over with water and exposed to a 50 Hz half-wave current, with the slurry being agitated in the while. Separation of clay particles and dispersion of lumpy clay occur as a result of various electrokinetic phenomena (electrophoresis, electrolysis, and electroosmosis) originating when an electric field is set up between the electrodes provided in the device. The drawback of this device is its low efficiency due to the feedstock being washed in batches whose quantity is defined by the capacity of the washing tank. On completion of the processing of one batch, the device has to be cut off the electric power supply to remove the clay sludge and the material separated from clay before the next batch can go in.

There is another prior-art device for disintegration of argillaceous materials (SU, Al, 724,190), comprising a cylindrical housing complete with a feed and a discharge nozzles, of which the first is installed tangential to the housing, and the second coaxial therewith. As the argillaceous feedstock is introduced, mixed with water, through the tangential feed nozzle, a hydraulic fluid stream is produced in the device, whirling around the axis of the housing and moving toward the discharge nozzle. In this whirling stream, turbulence are formed, as well as high peripheral speed gradients, and these give rise to shear stresses in argillaceous material lumps. Said stresses, as well as collisions between lumps and their friction against one another and against the housing walls, cause the softened water-soaked top layers to come off the lumps, resulting in the dispersion of the clay contained in the hydraulic fluid.

The drawback of this device is its low disintegration efficiency in regard to difficult-to-wash and high-clay rock materials composed of finely divided particles firmly bonded with one another. Due to the short residence in the device, there is not time enough for the feedstock lumps to get impregnated with water but to a comparatively low depth while the interplay of said lumps, which should result in separation therefrom of water-impregnated and therefore low in cohesion outer layers, is not active enough owing to the unidirectional movement of the feedstock stream. According to studies undertaken by the inventors, the efficiency achievable in the device in disintegration of such rocks as, e.g., kimberlite will not exceed 20 to 30%.

The present invention is based upon the objective of developing a device for disintegration of argillaceous materials, tat would provide an additional effect upon the argillaceous feedstock to promote its impregnation with water and removal of water-impregnated clay from solid components of the mixture.

DISCLOSURE OF THE INVENTION

The objective as stated above is achieved by providing a device for disintegration of argillaceous materials, comprising a cylindrical housing, a feed pipe fitted tangential to the housing, and a discharge pipe, in which device, in accordance with the invention, there are provided a plurality of vanes spaced within the housing circumferentially and axially and mounted on die inner cylindrical surface of the housing between the outlet of the feed pipe and the inlet of the discharge pipe, with each vane arranged in a manner such that the angle between the tangent to the cylindrical surface of the housing in the plane of the said vane and the plane perpendicular to the axis of the housing, is between 0° and 60°.

Owing to the vanes mounted on the inner surface of the housing in said fashion, the proposed device affords multiple (according to the number of vanes) pressure variations in the hydraulic fluid stream moving in a spiral path, the pressure increasing in front of each vane and decreasing behind the vane to give rise to the formation of cavitation zones. As a results, the argillaceous feedstock in the hydraulic fluid is exposed not only to centrifugal forces and turbulences, but also and at the same time to pressure differentials and cavitation effects. In additions, there are numerous collisions between feedstock lumps and vanes to take into account. All these factors will favour both faster clay impregnation and faster separation of water-impregnated layers off clay lumps, with higher disintegration efficiency as the net result.

With the angle between the tangent to the cylindrical surface of the housing in the plane of the vane and the plane perpendicular to die axis of the housing increasing to above 60°, the disintegration efficiency will decrease due to the hydraulic fluid stream being retarded and the hydraulic losses increased.

The device may contains another feed pipe, likewise tangential to the housing, with the outlets of both the feed pipes being symmetrical relative to the axis of the housing.

In this case, the disintegration efficiency is additionally increased due to there being provided two hydraulic fluid streams in counter flow.

In the sequel, the invention is made more fully apparent through a detailed description of its best embodiments, with due references to the accompanying drawings.

BEST MODE TO CARRY THE INVENTION INTO EFFECT

Figure 1:
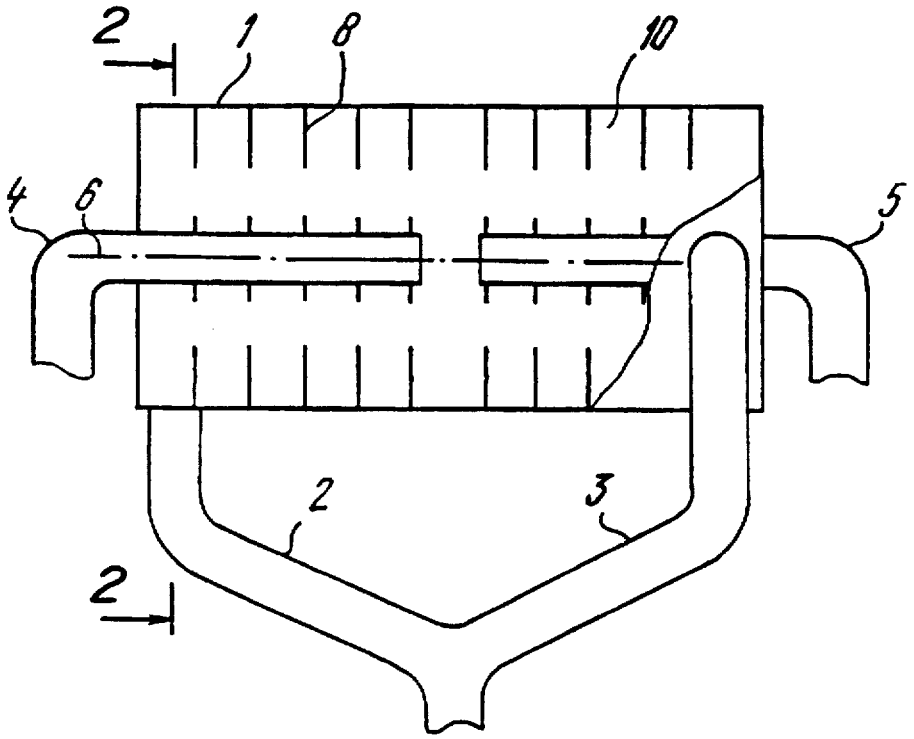
FIG. 1 is a schematic illustration of one of the embodiments of the device for disintegration of argillaceous materials, according to the invention, in longitudinal section.

The device for disintegration of argillaceous materials comprises a cylindrical housing 1 (FIG. 1) complete with two feed pipes 2 and 3 fitted tangential to the housing and two discharge pipes 4 and 5 fitted coaxial therewith. The feed pipes 2 and 3 are mounted close to the end walls of the housing 1, with their outlets displaced relative to each other axially and oriented relative to each other in such a way as to ensure the two outgoing hydraulic fluid streams whirling in opposite direction. Thus, as may be seen from FIG. 2, the stream leaving the pipe 2 will whirl clockwise while the stream from the pipe 3 will whirl counterclockwise. For this condition to be met, it is requisite that the projections of the pipes 2 and 3 on to the plane perpendicular to the axis 6 of to housing 1 (in FIG. 2 this plane coincides with the plane of the drawing) be symmetrical. The axis of symmetry 7 of the pipes 2 and 3 on said plane is the diameter of the cylinder of the housing 1, which is to be found at mid distance between them.

Each of the discharge pipes 4 and 5 is passed inside the housing 1 nearly as fair as half its length, the minimum distance between the inlets of said pipes being limited by increasing hydraulic losses in the device.

According to the invention, the inner cylindrical surface of the housing 1 has mounted on it, e.g. welded to, a plurality of vanes 8, in the form of plates, which are distributed circumferentially. Said vanes 8 are arranged in rows following the length of the housing 1 between the outlet of each of the feed pipes 2 or 3 and the inlet of the corresponding discharge pipe 4 or 5. The pitch selected for spacing said vanes 8 circumferentially and axially, in other words the dimensions of the circumferential and axial gaps therebetween, 9 and 10, respectively, will be dependent upon the lump size of the argillaceous material to be disintegrated and the flow rate of the incoming hydraulic fluid: the greater the feedstock lump size, the larger the axial gap 10; the higher the hydraulic-fluid flow rate, the larger the circumferential gap 9. The radial dimension of the vanes 8 is directly related to tie concentration of solid phase in the hydraulic fluid while the number of vanes per row is directly related to the clay content in the material to be disintegrated.

Figure 2:
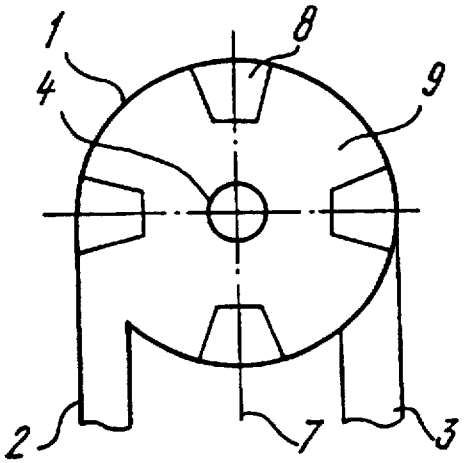
FIG. 2 is Section 2—2 of FIG. 1.
Figure 3:
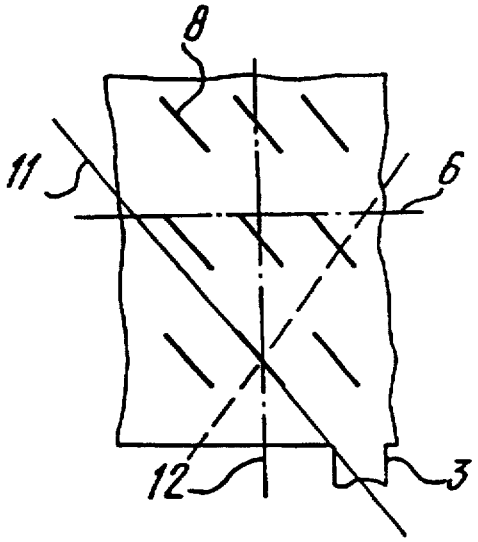
FIG. 3 is a fragment of the developed inner surface of the housing of the proposed device, with the vanes rotated relative to the cross-sectional plane of the housing from the position shown in FIGS. 1 and 2.

In the device as shown in FIGS. 1 and 2, the plane of each of the vanes 8 is perpendicular to the as 6 of the housing 1. However the vanes 8 may be rotated relative to the cross-sectional plane of the housing, as shown in FIG. 3, on either side. By correlating the two vane orientation versions, it can be stated that the angle between the tangent 11 to the cylindrical surface of the housing 1 in the plane of the vane 8 and the plane 12 perpendicular to the axis 6 of the housing 1, is within 0° and 60°. In the device illustrated in FIGS. 1 and 2, said angle is equal to zero. The specific angle value is selected based on the prerequisite of achieving maximum disintegration efficiency consistent with given design parameters and given physical properties of the material to be disintegrated. It is not advisable to increase the angle to over 60° because this would lead to the hydraulic fluid stream being retarded and to lower clay washout intensities.

The design of the proposed device as shown in FIGS. 1 and 2 is preferable from the viewpoint of effectiveness. However, other embodiments of the device according to the invention may be possible. Thus, the device may have one tangential feed pipe and one axial discharge pipe, with the latter being elongated, as in FIG. 1, or of normal length, with its inlet close to the end face of the housing, wherein this pipe is mounted. Also, a design is possible with two opposed axial discharge pipes and one tangential feed pipe in between them, in the central pan of the housing. Besides, it is not at all requisite for the axis of the discharge pipe (or pipes) to coincide with the axis of the housing. Further, the vanes disposed in the device within one cross-sectional (one circumference) may be fabricated as an integral assembly, by, e.g., stamping, being interconnected by narrow curved connecting strips adjoining the inner surface of the housing.

The device operates as follows. The argillaceous feedstock, in the form of a hydraulic fluid, is fed under pressure into the housing 1 simultaneously through the two feed pipes 2 and 3. Owing to the tangential orientation of the pipes 2 and 3, the outgoing streams assume a rotating type of motion. The hydraulic fluid stream supplied through the feed pipe 2 rotates clockwise if viewed from the side of the discharge pipe 4, while the hydraulic fluid stream supplied from the feed pipe 3 rotates counterclockwise. In the process of thus rotating, the two streams are displaced along the axis 6 of the housing 1 in counter directions, toward each other. While moving in spiral paths, the streams impinge upon the vanes 8, at an angle thereto, bypassing them through the circumferential and axial gaps 9 and 10, respectively. With such a pattern of flow, a zone of increased pressure is created before each vane 8, on the front side of the oncoming stream, and a zone of decreased pressure on the opposite side. Decreasing pressure results in cavitation voids being formed in the material. These voids are filled with air bubbles which adhere to clay lumps. As they enter the higher pressure zone, in front of the next vane 8 in the stream path, the cavitation bubbles burst, destroying the soaked top clay layer. As the stream moves onwards in a spiral path, the clay lumps pass repeatedly, according to the number of vanes 8 in the path, through low and high pressure zones, the result being their becoming fast impregnated with water. The water-impregnated clay layers separate due to the combined effect of cavitation and turbulences, as well as collisions with the vanes 8, friction against the inner surface of the housing 1, and collisions between lumps. As a result, clay lumps are rapidly destroyed. In the mid section of the housing 1, the two rotating streams, whirling in the opposite directions, come together, with the clay lumps actively interacting and abrading one another to liberate mineral grains. The hydraulic fluid continuously fed into the housing 1 tends to displace finely divided clay particles and liberated mineral grains toward the centerline and thence out, through the discharge pipes 4 and 5.

Industrial Applicability

The proposed device is liable to find the widest possible application in any field where the requirement is for disintegration of difficult-to-wash and high-clay rock materials. Comparative tests show that the proposed device can provide an efficiency in disintegration of difficult-to-wash and high-clay rock materials several times that achievable with the presently-used counterparts of close constructional and process parameters.

We claim:

1. A device for disintegration of argillaceous materials, comprising:

a cylindrical housing;

a feed pipe fitted tangential to the housing;

a discharge pipe; and a plurality of vanes, spaced within the housing circumferentially and axially, being mounted on an inner cylindrical surface of the housing between an outlet of the feed pipe and an inlet of the discharge pipe, with each vane arranged in a manner such that an angle, between tangent to the inner cylindrical surface of the housing in a plane of said vane and a plane perpendicular to an axis of the housing, is between 0 and 60 degrees.

2. A device for disintegration of argillaceous materials as defined in claim 1, further comprising a second feed pipe fitted tangential to the housing, the second feed pipe having an outlet, the outlets of the feed pipes being displaced relative to each other along the axis of the housing, and projections of the feed pipes on to the plane perpendicular to the axis of the housing being symmetrical.

* * * * *